United States Patent [19]

Jenkins

[11] 4,048,977

[45] Sept. 20, 1977

[54] FLUTE BREAKER

[76] Inventor: Jimmie M. Jenkins, Rte. No. 3, Canton, Miss. 39046

[21] Appl. No.: 650,514

[22] Filed: Jan. 19, 1976

[51] Int. Cl.[2] ..... B28D 1/32

[52] U.S. Cl. ..... 125/23 R; 227/97

[58] Field of Search ..... 225/97, 103; 125/2, 125/23

[56] References Cited

U.S. PATENT DOCUMENTS

| | | | |
|---|---|---|---|
| 2,867,204 | 1/1959 | Arvay | 125/23 R X |
| 2,958,163 | 11/1960 | Cammerzell | 125/23 R X |
| 3,907,185 | 9/1975 | Suzuki | 225/97 |

FOREIGN PATENT DOCUMENTS

| | | | |
|---|---|---|---|
| 195,571 | 2/1908 | Germany | 125/23 R |
| 844,920 | 8/1960 | United Kingdom | 125/23 R |

*Primary Examiner*—Harold D. Whitehead
*Attorney, Agent, or Firm*—Fitch, Even, Tabin & Luedeka

[57] ABSTRACT

An apparatus for breaking the flutes from fluted blocks. The apparatus includes breaker head means for engaging opposite surfaces of a block flute and means for rotating the breaker head means to apply rotational forces which break the flute from the block forming decorative surfaces. In order to facilitate the engagement of the fluted blocks with the breaker head an infeed conveyor and block positioning means are provided to move the flutes of fluted blocks into engagement with the breaker head means and to withdraw the block after the flutes have been broken off. Further means are provided to propel the block to a discharge conveyor from which the blocks may be removed and stacked for shipment.

6 Claims, 6 Drawing Figures

FLUTE BREAKER

The present invention relates, in general, to apparatus for producing decorative surfaces on building blocks, and, in particular, to apparatus for semiautomatically breaking off flutes on fluted building blocks to provide a decorative surface.

Building blocks such as concrete blocks, light weight aggregate blocks, and the like, are often provided with decorative surfaces. One form of such decorative surface is provided by breaking off portions of the surface of the block to provide spaced-apart bands of fractured or broken aggregate separated by bands of finished surface. One known method of providing such bands of broken or fractured surfaces involves a process which includes first molding, as a unit, a pair of spaced apart blocks which are joined together by spaced-apart, parallel webs of aggregate, which are disposed parallel to the thickness of the block and which are normal to the facing surfaces of the joined blocks. After the joined blocks are cured, they are placed in a guillotine type breaking device wherein pressure is applied to the top and bottom of the webs which interconnect the two joined blocks, the pressure causing the webs to fracture to provide the broken surfaces.

Another known method of forming such surfaces is by providing a block having parallel, spaced-apart flutes which extend at right angles to one surface of the block. The flutes are broken off by clamping each flute in a set of tongs and striking it with a mallet or the like to break off the flute, thereby providing the desirable band of broken or fractured surface.

The prior methods and apparatus for providing the fractured surfaces have been inefficient in that they have been slow and cumbersome and such methods have also had the disadvantage that the fracture of either the flute or the web is often marred by the apparatus or tools employed. In addition, the pior methods and apparatus do not provide broken surfaces which are of a predictable character.

Accordingly, the principle object of this invention is the provision of improved apparatus for breaking the flutes from fluted blocks. A further object of the invention is the provision of apparatus for breaking flutes in a generally predictable manner. Another object of the invention is the provision of apparatus of the class described which will break the flutes from a fluted block in a semiautomatic manner so as to provide improved economy of operation.

Other objects and advantages of the invention will become known by reference to the following description and accompanying drawings in which.

Figure 1:
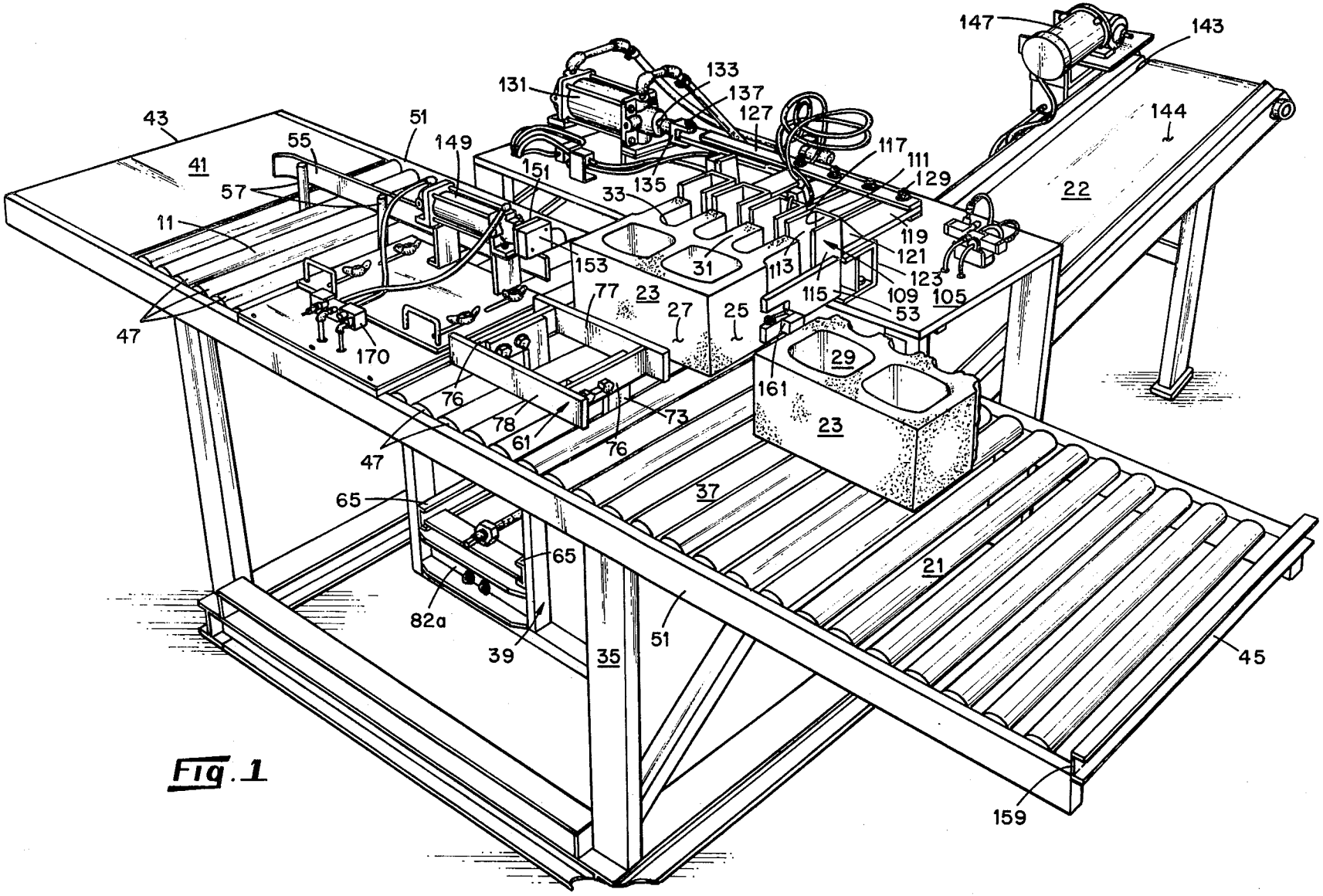
FIG. 1 is a perspective view of a flute breaking apparatus embodying various of the features of the invention.
Figure 2:
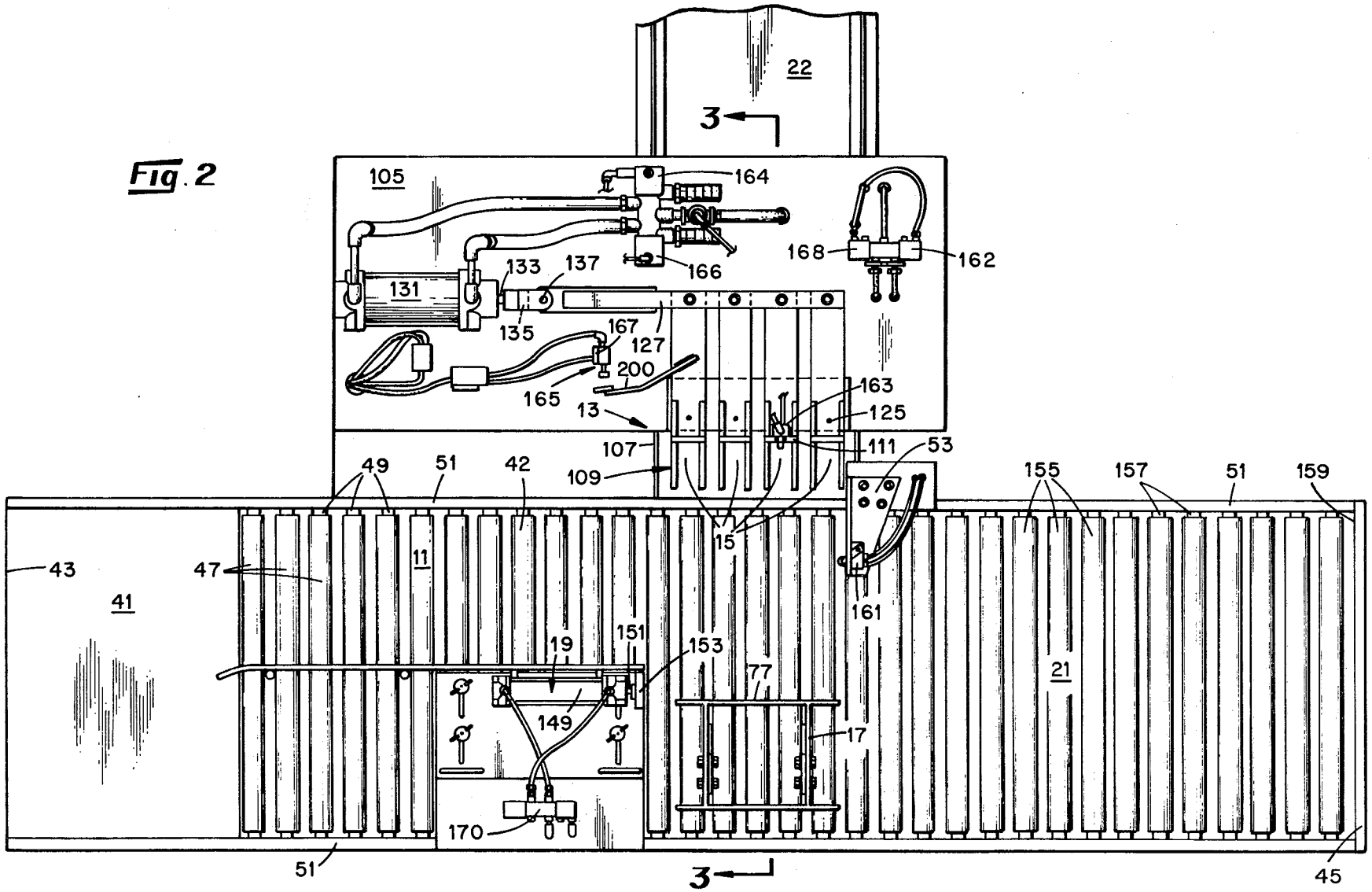
FIG. 2 is a fragmentary plan view of the apparatus shown in FIG. 1.

In the illustrated embodiment, the breaking of the flutes is accomplished by a bifurcated breaker head which straddles a flute and which is adapted to provide a line of breakage along one surface of the flute. In operation, the breaker head is rotated to apply pressure along the line of breakage as a fulcurm on one side of the flute inwardly of its end and to provide pressure on the other side of the flute, adjacent its outer end to provide a rotational force which snaps off the flute generally along the line of breakage or fulcrum. Desirably, the line of breakage or fulcrum of the breaker head extends completely across the surface of the flute as does the line of pressure at the outer end of the flute. It has been found that such a breaking action provides a generally predictable fractured surface which results in an attractive decorative finish.

In order to facilitate the engagement of the fluted blocks with the breaker head, the illustrated embodiment includes an infeed conveyor 11 on which the blocks may be either mechanically or manually placed and which is adapted to convey the blocks to breaker head assembly 13 which includes a plurality of breaker heads 15. A block positioning means 17 is provided to move the flutes of the fluted blocks into engagement with the breaker heads 15 and to withdraw the block, after the flutes have been broken off by breaker heads 15 and to position it in front of a block pusher assembly 19 which is adapted to propel the block to a discharge conveyor 21 from which the blocks may be removed and stacked for shipment. The illustrated embodiment also includes a conveyor 22 for carrying away the broken off flutes.

Figure 4:
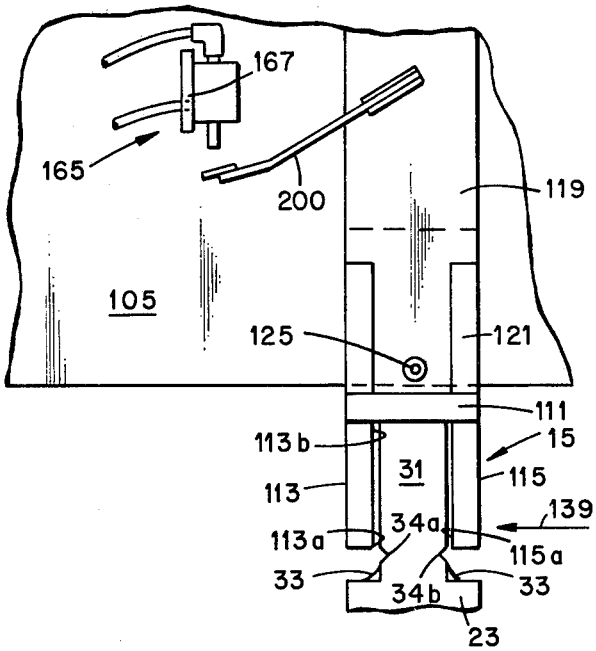
FIG. 4 is an enlarged, fragmentary, plan view of a breaker head which constitutes a part of the apparatus shown in the preceding Figures.

In FIG. 1, there is illustrated a typical fluted concrete building block 23. It includes the usual end walls 25 and one finished side wall 27, as well as the usual core holes 29. The remaining side wall of the block is formed with integral, outwardly extending flutes 31 which extend outwardly from the surface of the block at right angles thereto. The flutes 31 are spaced apart and the area between the flutes on the surface of the block may be provided with a slightly curved configuration, as shown at 33, or the area between the flutes may be flat or in another shape, if desired. Further, the flutes 31 may be fabricated to include breaking grooves 34*a–b,* as shown in FIG. 4, to assist formation of uniform fractured surfaces when the flutes 31 are broken away as will be described more fully hereinafter.

The infeed conveyor 11, the block positioning means 17, the block pusher assembly 19, and the discharge conveyor 21 are supported upon a frame 35 of fabricated construction. The frame 35, as will hereinafter be described, provides a generally horizontal, table-like, section 37, which is positioned at the desired height and a sub-frame 39 which supports the block positioning means 17. The frame may be fabricated from any appropriate structural members to accommodate the positioning of the various elements of the apparatus.

The infeed conveyor 11 is adapted to convey the blocks to the breaker head assembly 13. In the illustrated apparatus, it is supported on the table-like section 37 of the frame 35 and includes a generally horizontal disposed apron 41 upon which the fluted blocks 23 may be placed and a roller conveyor 42. In the illustrated embodiment, the infeed conveyor 11 is in the form of a roller conveyor along which an operator pushes the blocks 23 into alignment with the breaker head assembly 13. If desired, the table-like section 37 of the frame 35 may be disposed with its upstream end 43 elevated slightly from its downstream end 45 so that the blocks move along the roller conveyor 42 by gravity. As illustrated, the roller conveyor 42 is disposed intermediate the apron 41 and the breaker head assembly 13 on the table-like section 37. The roller conveyor 42 includes a plurality of transversely disposed conveyor rollers 47, each of which includes a supporting shaft 49 which is journaled in longitudinal members 51 of the frame 35. In operation, fluted blocks are placed upon the apron 41 and are pushed on to the rollers 47 whereupon they roll down the conveyor until they are engaged by a stop bracket 53 at the downstream end of the roller conveyor 42. The bracket 53 is attached to the frame 35 and extends transversely of the infeed conveyor 11. The stop bracket 53 is positioned adjacent the downstream end of the breaker head assembly 13, so as to position each of the flutes 31 of the block 23 in registration with a corresponding breaker head 15.

In order that the blocks 23 are maintained in alignment on the roller conveyor 42, a guide rail 55 is supported from the frame on posts 57, the guide rail 55 engaging the flat rearward surface 27 of the fluted blocks 23 so as to maintain the blocks in alignment as they roll down the conveyor 11. While an apron and roller conveyor have been described it is apparent that other types of conveying means may be employed to position the block in registration with the breaker heads 15.

The block positioning means 17 is mounted on the sub-frame 39 and includes a reciprocatable carriage 59 which carries a pusher plate assembly 61 and a block withdrawing assembly 63. The carriage 59 is mounted for reciprocation in a pair of facing channels 65 which extend transversely and below the table section 37 and are supported on the sub-frame 39. The carriage includes two pairs of supporting rollers 67 (only one of which is shown) which ride in the channels 65 and which support the carriage 59 which bridges the channels 65. A pair of sockets 71 are attached to the carriage 59 to carry the pusher plate assembly 61.

The pusher plate assembly 61 includes a pair of vertically extending posts 73 which are proportioned to fit between the rollers 67 on the carriage 59. The lower end of each of the posts 73 are supported in one of the sockets 71 and the upper end of each of the posts 73 are connected to a rectangular pusher plate 75. The pusher plate 75 includes cross members 76 which extend transversely of the table section 37 and which at one end support the forward ends of a pusher bar 77 which is adapted to engage the rearward surface of the block 23. In order that the pusher plate is adaptable to blocks of varying width, e.g. 8 inch or 4 inch blocks, the pusher plate 75 also includes a pusher bar 78 on its rearward side, connected to the other ends of the cross members 76. The distance from the posts 73 to the face of the pusher bar 77 is proportioned to move an 8 inch block into the desired position in the breaker heads 15 and, in the event that a 4 inch block is to be processed, the distance from the posts 73 to the face of the bar 78 is sufficient to accommodate a 4 inch block. Thus, when one is charging from an 8 inch block to a 4 inch block it is only necessary to lift the posts 73 out of their associated sockets 71, rotate the pusher assembly 180° and reinsert the posts 73 in the sockets 71 to obtain the desired changeover adjustment.

In order to reciprocate the block ejector carriage 59 a pneumatic cylinder 81 is provided, one end being attached to a sub-frame member **82*a* of the subframe 39 and the piston rod 83 of which is connected to a web 84 on the carriage 59 by means of a clevis 85 and pin 86**.

Figure 3:
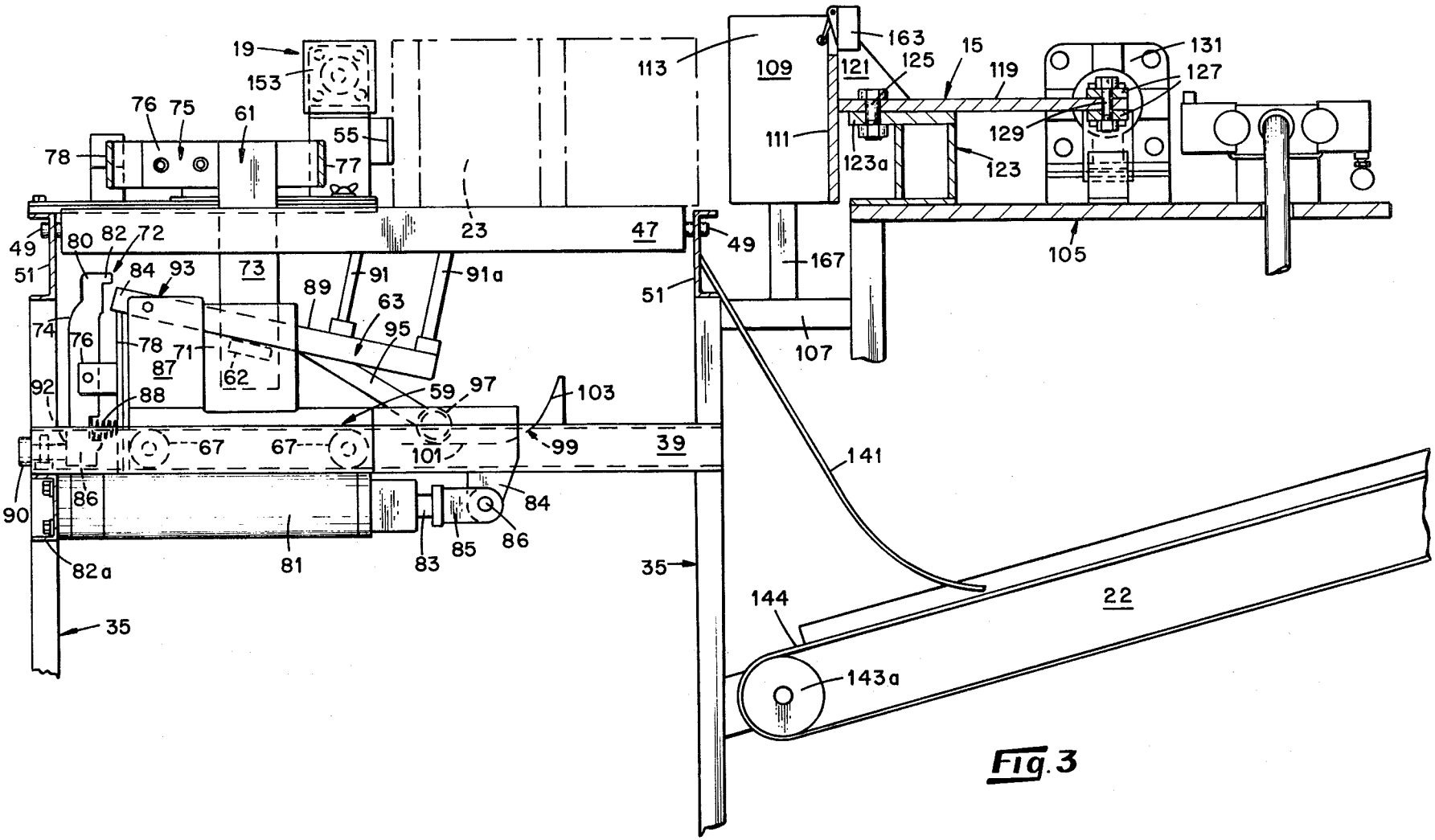
FIG. 3 is a fragmentary sectional view taken along line 3—3 in FIG. 2.

As will be seen from the drawings, energization of the pneumatic cylinder 81 to extend the piston rod 83 moves the carriage 59 to the right in FIG. 3, thereby engaging the pusher bar 77 against the rearward surface 27 of the block 23. This moves the flutes 31 into the breaker head assembly 13.

As pointed out above, the block positioner means also includes block withdrawing means 63 for withdrawing the block 23, transversely of the conveyor 11 after the flutes have been broken from the block. As illustrated, particularly in FIG. 3, the carriage 59 also includes an upstanding web 87 in which is journaled a pivoted arm 89, one end of which carries two pairs of upstanding rods 91 and **91*a*. In FIG. 3 only one each pair of rods 91 and 91*a* is shown, each rod in each pair being spaced apart to correspond to the standard spacing of block cores. The other end of the arm 89 is pivotally supported at 93 in the web 87 so that the arm 89 can move up and down in a plane transversely disposed relative to the conveyor 42**.

Attached to the arm 89 is a cam arm 95 which carries at its outer end a cam follower roller 97. The cam follower roller 97 engages a cam surface 99 supported on the frame 39. The cam surface 99 includes a depressed area 101 and an elevated area 103. In the illustrated embodiment, a key stock stop 62 is secured at its opposite ends to the inner walls of the sockets 71 to provide a rest for the arm 89 as the cam follower roller 97 passes over the depressed area 101 of the cam surface 99.

In operation, as the carriage 59 is moved to the right in FIG. 3 under the action of the hydraulic cylinder 81, the cam follower roller 97 rides on the cam surface 99 and, during the final stages of the movement of the carriage rides up the cam surface from the depressed area 101 to the elevated area 103 to cause the pairs of rods 91 and **91*a* to move upwardly into the cores 29 of the block being processed, both of the pairs of rods 91 and 91*a* move into the cores of the block but, in the event that a 4 inch block is being processed only the pair of rods 91*a*** move into the cores of the block.

In order to maintain the pins 91 and **91*a* in an elevated position for removal of a block from the breaker head assembly 13, ejector latch means 72 are provided. The illustrated ejector latch means includes a substantially upright latch member 74 which is pivotally mounted in a clevis 76 secured to a bracket 78 mounted on the carriage 59. The upper end portion 80 of the latch 74 is provided with a detent 82 that engages the end 84 of the pivoted arm 89 as the cam follower roller 97 moves upward along the elevated area 103 of the cam. To this end, the lower end portion 86 of the latch is spring biased outwardly from the bracket 78 by a spring 88 which pivots the upper end portion 80 of the latch member 74 toward the end 84 of the arm 89 for engagement. In this connection, the latch 74 maintains the arm 89 and pins 91 and 91*a* in an uplifted position for moving a block from the breaker head assembly 13 as the cam follower roller passes above the depressed area 101 of the surface 99 during the return stroke of the cylinder 81**.

An adjustable stud 90 is mounted on the subframe 39 and adapted to engage the latch surface 92 to compress the spring 88 and release the pivoted arm 89 to allow the pins 91 and **91*a* to fall out of the block cores when the block is moved into alignment with the block pusher assembly 19**.

The breaker head assembly 13 is supported upon a table-like frame 105 which is adjacent to and spaced from the main frame 35, a distance sufficient to permit the broken-off flutes to fall between the frame 105 and the frame 35. The frames 105 and 35 are rigidly interconnected by structural member 107. Each of the breaker heads 15 includes a bifurcated member 109 which includes a base panel and two side panels 113 and 115, the side panels providing a recess 117 having a depth which is sufficient to align the marginal edges 113*a* and 115*a* of the side panels 113 and 115 with the line along which the flute is to be broken. The recess 117 is proportioned to receive a flute to be broken and is vertically disposed, as illustrated. Each of the side panels 113 and 115 are preferably of a length sufficient to extend over the entire height of a flute. The bifurcated member 109 is rigidly attached to pivot arms 119 which extends horizontally and the connection between the bifurcated member 109 and the arm 119 is reinforced by suitable gussets 121.

The breaker head assembly 13 includes a plurality of breaker heads 15, one for each of the flutes 31 on the block. The breaker heads 15 are each supported upon a reinforced channel 123 which is attached to the frame 105. The attachment is accomplished by a vertically extending pins or bolts 125 which extend through the arm 119, at a point adjacent the bifurcated member 109, the bolts 125 extending through the channel member 123*a* so as to provide pivotal connections which permit rotation of the breaker heads 15 about the pivot in a horizontal plane.

The end of each of the pivot arms 119 is connected to an actuating lever 127 by a vertically extending bolt or the like which provides a pivot between the actuating lever 127 and the pivot arm 119. As illustrated, the pivot arms 119 of each of the breaker heads 15 are aligned in a parallel relationship so that movement of the actuating lever 127 causes the breaker heads 15 to pivot in unison about each of their respective pivots 125. Pivoting of the breaker heads is accomplished by a pneumatic cylinder 131 whose piston rod 133 is connected by means of a clevis 135 and a vertically extending pin 137 to the actuating lever 127.

In operation, the fluted block 23 is positioned with each of its flutes 31 in a bifurcated member 109 on one of the breaker heads 15. The pneumatic cylinder 131 is actuated to extend the piston rod 133 which in turn, through the actuating lever 127 rotates the breaker heads about the pivots 125 to break the flutes.

FIG. 4, which is an enlarged plan view of the relationship of a breaker head 15 and a flute 31 illustrates the action which is accomplished. Actuation of the pneumatic cylinder 131 causes the outer end of the bifurcated member 109 to move in the direction shown by the arrow 139. This causes a line contact to be made between the flute and the marginal edge 115*a* of the side panel 115. The flutes 31 of the block 23 illustrated in FIG. 4 include breaking grooves 34*a* and 34*b* which assist in the formation of predictable fractured surfaces. In this connection, the marginal edge 115*a* on the side panel 115 forms a line contact with the breaking groove 34*b*. At the same time, the base 113*b* of the side panel 113 engages the outer end of the flute 31 on its opposite side so that the flute 31 is rotated about line 115*a* as a fulcrum to accomplish the breaking operation. It is obvious that the side panel 113 need not be of the same dimensions as the side member 115, since only its base area is employed in breaking a flute which extends into the recess 117 against the base 111. However, if it is desired to insert the flute to different depths in the recess 117, it will be necessary to extend the panel 113 far enough to engage the outer end of the flute. For ease of fabrication, however, it is desirable to fabricate both of the side panels 113 and 115 with the same dimensions, as illustrated.

Figure 5:
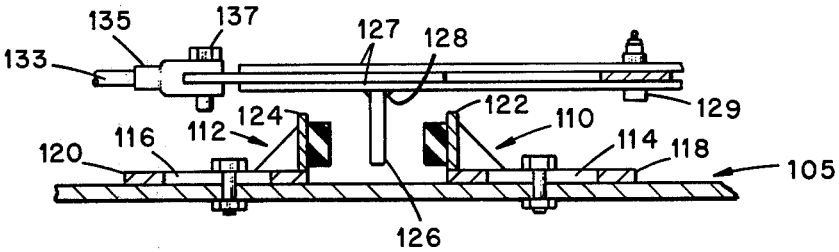
FIG. 5 is a side elevation view of a fragmentary section of the apparatus shown in FIG. 1.

In order to prevent aberrational movement of the piston arm 133 and the connected actuating lever 127, means are provided to limit the forward and back stroke of the pneumatic cylinder 131. The illustrated limit means, shown in FIG. 5, includes spaced apart L-shaped stops 110 and 112 which are adjustably mounted on the frame 105 by bolts which extend through elongated holes 114 and 116 in the horizontal sections 118 and 120, respectively. Upright sections 122 and 124 of the stops 110 and 112 are provided with rubber pads adapted to engage a downwardly depending member 126 welded along its upper edge 128 to the actuating lever 127.

The take away conveyor 22 is provided to dispose the broken flutes. In the illustrated embodiment, the take away conveyor includes a chute 141 which is supported on the frame 35 which bridges the frames 35 and 105, and on to which the broken flutes fall. The chute 141 deposits the broken flutes on the conveyor 22 which includes a driving roller 143, a tail roller 143*a*, and a belt 144, as illustrated. The driving roller is connected with a suitable power source such as the motor 147.

As has been pointed out, after the flutes are broken the block positioning means 17 is operable to withdraw the blocks from the vicinity of the breaker heads. The block pusher means 19 then propels the blocks from which the flutes have been broken on to the discharge conveyor 21. The block pusher means 19 includes a pneumatic cylinder 149 having a piston rod 151 to which is connected a plunger 153. After the block is withdrawn, the pneumatic cylinder 149 is actuated to extend the plunger 153 against the end surfaces of the block 23 to propel it down the discharge conveyor 21.

The discharge conveyor 21 includes a plurality of conveyor rollers 155, each mounted for rotation on a shaft 157 which is journaled in the side members 51 of the frame 35. In order to prevent the blocks from running over the end of the discharge conveyor 21 a stop bar 159 is provided at the end of the discharge conveyor.

The operation and control of the apparatus is as follows. Fluted blocks 23 are placed on the conveyor 11 and ride along the conveyor until they engage the web 53 which stops the block in front of the breaker head assembly 13. The web 53 carries a limit switch 161 which is actuated by contact with a block. The limit switch 161 actuates a solenoid controlled valve 162 which applies air pressure to the pneumatic cylinder 81 to extend the piston rod 83 to move the carriage 59 to engage the pusher bar 77 against the rearward side of the block 23 and to move the flutes 31 of the block into the breaker heads 15. The base plate 111 of one of the breaker heads 15 carries a limit switch 163. Contact between the limit switch 163 and a flute 31 actuates a solenoid controlled valve 164 which applies air pressure to pneumatic cylinder 131 to extend the piston rod 133 which in turn moves the actuating lever 127 to rotate the breaker heads 15 to break the flutes in the manner described.

Maximum extension of the piston rod 133 and consequent maximum rotation of the breaker heads 15 causes cam arm 200 mounted on one of the pivot arms 119 to engage a limit switch 165 which is supported upon the frame member 105 by a bracket 167. Contact between the cam arm 200 and the limit switch 165 actuates a solenoid controlled valve 166. Valves 164 and 166 cause the piston rod 133 to extend outwardly and retract by a predetermined amount which is adjustable by restricting the air pressure. In the event of a failure of one or both of the valves 164 and 166, the stops 110 and 127 limit the stroke of the piston rod 133.

Figure 6:
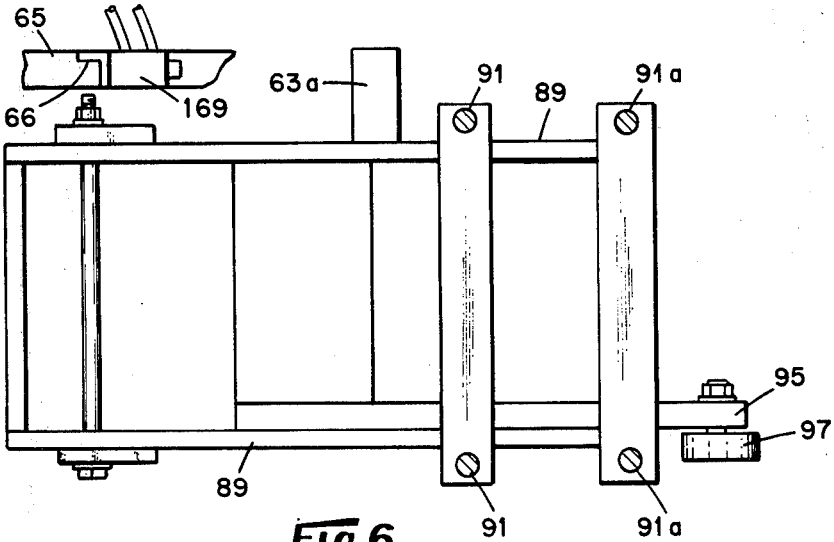
FIG. 6 is a diagrammatic plan view of a fragmentary section of the apparatus shown in FIG. 1.

Contact between the cam arm 200 and the limit switch 165 further actuates a solenoid controlled valve 168 to apply pressure air to the cylinder 81 to retract the carriage 59 thereby withdrawing the block from the vicinity of the breaker head 15 in a manner which has been described. When the carriage 59 is in its fully withdrawn position, the cam arm 63*a* mounted on the arm 89, shown in FIG. 6, contacts a further limit switch 169 which is mounted on channel 65 by a bracket 66. Limit switch 169 actuates a solenoid controlled valve system 170 for the pneumatic cylinder 149 to extend and retract the piston rod 151 which causes the plate 153 to engage the end of the block and propel it down the discharge conveyor 21. The broken flutes fall on to the take away conveyor 22 and are discharged to a disposal point. The operation is repeated as additional blocks are fed on to the conveyor 11.

The apparatus which has been described provides rapid and efficient breaking of flutes from fluted blocks and, in addition, provides generally predictable fractures so as to enhance the appearance of the block surfaces.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. Apparatus for developing a decorative surface on a frangible building block having a flute extending at substantially a right angle to and outwardly from said surface of said block by breaking said flute from said block at a location inwardly of the distal end of said flute comprising a breaker head including base means mounted for pivotal movement relative to said flute about a pivot located outwardly of and away from said flute, a rigid fulcrum member extending from said base means to a location on one side of said flute adjacent the position of the desired break of said flute, and an anvil member extending from said base to a location adjacent said distal end of said flute and on the opposite side of said flute as said fulcrum member, said fulcrum member and said anvil member being immovable with respect to one another and defining an opening therebetween to receive said flute, the spacing between said fulcrum and anvil members being of a dimension greater than the corresponding dimension of the flute disposed therebetween, means urging said flute on said block into a position between said fulcrum and anvil members while not placing absolute restraint against movement of said block in a direction generally perpendicular to the direction said flute extends from said block, and means for rotating said breaker head in a direction whereby said fulcrum member contacts said flute adjacent the desired break and said anvil member contacts the distant end of said flute on the side thereof opposite said fulcrum member to exert a breaking force to said flute.

2. Apparatus. in accordance with claim 1, wherein said breaker head means includes a bifurcated member having a pair of panel members oriented in respective planes that are mutually parallel and substantially parallel to said flute, said panel members being spaced apart from one another by a distance greater than the thickness of said flute whereby said flute is received between said panel members, and wherein rotation of said bifurcated unit causes a marginal edge of one of said panel members to engage one side of said flute thereby establishing a fulcrum, and the other of said panel members to engage the opposite side of said flute at a location adjacent the distal end of said flute to break said flute generally along the line of said marginal edge of said one panel.

3. Apparatus in accordance with claim 2 wherein the marginal edge of said one panel is of a length sufficient to engage the surface of said flute to provide a fulcrum which defines a line across the entire surface of said flute.

4. Apparatus in accordance with claim 3 wherein said breaker head means includes a bifurcated member for each flute on said block, said bifurcated members being spaced apart so that one bifurcated member registers with one flute on said block, and wherein said means for rotating said breaker head means simultaneously rotates all of said bifurcated members in unison.

5. Apparatus for making decorative surfaces on a building block having a plurality of flutes extending outwardly from one surface thereof including:

a frame;

breaker head means supported on said frame for engaging each of the flutes on a block;

means for rotating said breaker head means to apply forces to each of said flutes which means causes portions of each of said flutes to be rotated relative to its plane;

a conveyor on said frame for moving said block to said breaker head means;

block positioning means including reciprocatable carriage means on said frame for moving said blocks into said breaker head means upon forward movement of said carriage means and means carried by said carriage means and engaging said block for withdrawing said blocks from said breaker head means upon rearward movement of said carriage means;

means responsive to movement of a block into said breaker head means for actuating said means for rotating said breaker head means to break said flutes; and, means responsive to rotation of said breaker head means to withdraw said block from said breaker head means.

6. Apparatus in accordance with claim 5 wherein said conveyor includes a stop for said blocks, means on said stop responsive to contact with a block to actuate said block positioning means to move said block into said breaker head means.

* * * * *